US006620266B1

(12) United States Patent
Williams et al.

(10) Patent No.: US 6,620,266 B1
(45) Date of Patent: Sep. 16, 2003

(54) GAS GENERANT COMPOSITIONS CONTAINING A SILICONE COATING

(75) Inventors: Graylon K. Williams, Warren, MI (US); Sean P. Burns, Almont, MI (US); Paresh S. Khandhadia, Troy, MI (US)

(73) Assignee: Automotive Systems Laboratory, Inc., Farmington Hills, MI (US)

( * ) Notice: Subject to any disclaimer, the term of this patent is extended or adjusted under 35 U.S.C. 154(b) by 0 days.

(21) Appl. No.: 09/608,871

(22) Filed: Jun. 30, 2000

Related U.S. Application Data

(60) Provisional application No. 60/142,226, filed on Jul. 2, 1999.

(51) Int. Cl.[7] ..... C06B 45/18; C06B 45/36; C06B 31/00; D03D 23/00

(52) U.S. Cl. ..... 149/3; 149/4; 149/45; 149/46; 149/109.6

(58) Field of Search ..... 149/46, 45, 3, 149/4, 109.6

(56) References Cited

U.S. PATENT DOCUMENTS

| | | | | | |
|---|---|---|---|---|---|
| 2,995,088 | A | * | 8/1961 | Asplund | 102/70 |
| 3,773,572 | A | * | 11/1973 | Thomas | 149/11 |
| 3,898,112 | A | * | 8/1975 | Strecker et al. | 149/19.9 |
| 3,909,322 | A | * | 9/1975 | Chang et al. | 149/19.4 |
| 3,964,256 | A | | 6/1976 | Plantif et al. | 60/219 |
| 3,986,908 | A | | 10/1976 | Grebért et al. | 149/19.7 |
| 4,330,346 | A | | 5/1982 | Alm et al. | 149/21 |
| 4,332,631 | A | | 6/1982 | Herty, III et al. | 149/19.2 |
| 5,585,048 | A | | 12/1996 | Schleicher et al. | 264/3.4 |
| 5,589,662 | A | | 12/1996 | Schleicher et al. | 149/35 |
| 5,610,444 | A | | 3/1997 | Austruy et al. | 264/3.3 |
| 5,700,532 | A | | 12/1997 | Chiou | 428/36.1 |
| 5,731,540 | A | | 3/1998 | Flanigan et al. | 149/109.6 |
| 5,756,929 | A | | 5/1998 | Lundstrom et al. | 149/22 |
| 5,780,768 | A | * | 7/1998 | Knowlton et al. | 149/36 |
| 6,019,861 | A | | 2/2000 | Canterberry et al. | 149/19.1 |
| 6,029,994 | A | | 2/2000 | Perotto et al. | 280/736 |
| 6,139,054 | A | * | 10/2000 | Blomauist | 280/741 |
| 6,306,232 | B1 | * | 10/2001 | Khandhadia et al. | 149/22 |

OTHER PUBLICATIONS

Compatibility of New Benzotrifuroxan Exrudable Formulations; International Symposium on Energetic Materials Technology; Mason & Hanger; 1994.

Polymeric Binder and the Combustion of Solid Propellants; Fraunhofer–Institut für Chemische Technologie (ICT) ; R.G. Stacer, S. and Eisele, N.Eisenreich; 1990.

Binder Influence on the Viscoelastic Properties of Solid Rocket Propellants; Chemical Propulsion Information Agency vol. III, D.M. Husband and R.G. Stacer; 1986.

* cited by examiner

*Primary Examiner*—Michael J. Carone
*Assistant Examiner*—Aileen B. Felton
(74) *Attorney, Agent, or Firm*—Dinnin & Dunn, P.C.

(57) ABSTRACT

Known gas generant compositions, absent elastomeric binders, are coated with silicone thereby providing a composition that exhibits enhanced moisture protection, ballistic performance, combustion properties, and gas production.

7 Claims, 1 Drawing Sheet

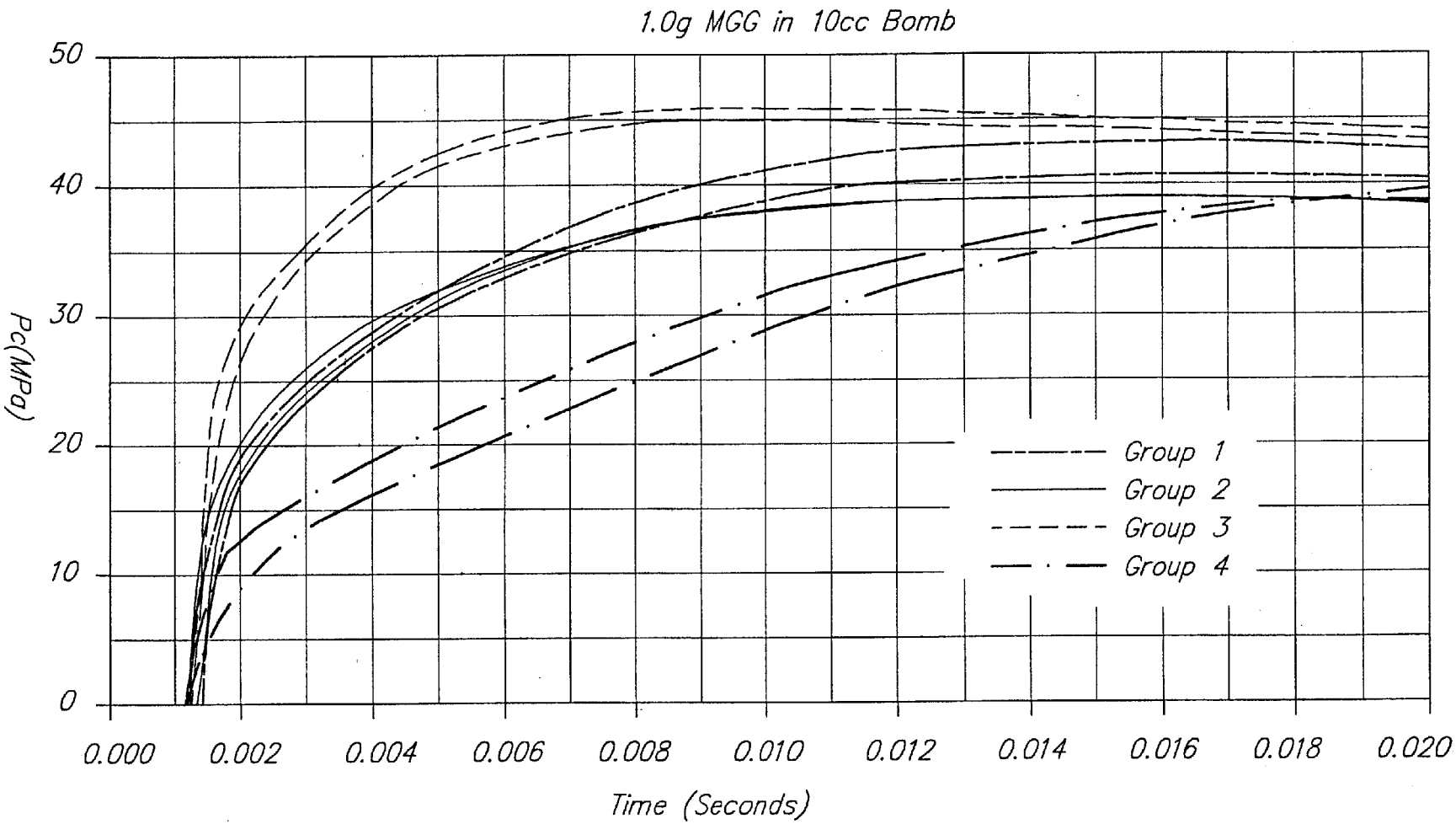
1.0g MGG in 10cc Bomb
Group 1
Group 2
Group 3
Group 4
Pc(MPa)
50
40
30
20
10
0
Time (Seconds)
0.000
0.002
0.004
0.006
0.008
0.010
0.012
0.014
0.016
0.018
0.020

GAS GENERANT COMPOSITIONS CONTAINING A SILICONE COATING

CROSS-REFERENCE TO RELATED APPLICATIONS

This application claims the benefit of U.S. Provisional Application Ser. No. 60/142,226 filed Jul. 2, 1999.

BACKGROUND OF THE INVENTION

Field of the Invention

The present invention relates to an improvement in the performance of a gas generator containing a pyrotechnic mixture in the form of granules or tablets, wherein the pyrotechnic mixture contains a nitrogen-containing fuel and an inorganic oxidizer.

One disadvantage of pyrotechnic mixtures within airbags inflators or seatbelt pretensioners, for example, includes poor moisture inhibition and therefore inconsistent performance. Relatively poor ignitability, poor sustained combustion, and low burn rates potentially cause poor inflator and/or pretensioner performance.

Conventional gas generant compositions such as those described in U.S. Pat. Nos. 5,035,757 and 5,139,588 are useful in vehicle occupant protection systems as applied within airbag inflator gas generators and in seatbelt pretensioners. However, nonazide gas generant compositions as exemplified therein may absorb moisture over time thereby inhibiting combustion performance. Furthermore, these compositions contain metal-containing oxidizers and thus produce relatively less gas and more solids when compared to other state of the art "smokeless" gas generants.

"Smokeless" gas generant compositions, such as those described in U.S. Pat. Nos. 5,872,329, 5,501,823, 5,783,773, and 5,545,272 (herein incorporated by reference) may be generally defined as producing at least 90% by weight of gas and not more than 10% by weight of solids upon combustion of the gas generant composition. These compositions have little, if any, metal-containing gas generant constituents and are also useful in vehicle occupant protection systems. However, nonazide compositions as exemplified therein may absorb moisture over time thereby inhibiting combustion performance.

Furthermore, to be useful in actuating vehicle occupant restraint systems, the formulations must ignite readily. "Smokeless" gas generants are often difficult to ignite and this sometimes results in inconsistent performance of an airbag inflator, for example. Finally, certain "smokeless" gas generants (i.e. reduced solid combustion products) exhibit reduced combustion sustenance; it is believed that reducing the metal containing compounds (and thereby reducing the combustion solids) also inhibits the burn characteristics of the composition. As a result, the composition may not fully burn and therefore may not provide the required performance.

SUMMARY OF THE INVENTION

The above-referenced problems are solved by coating any given gas generant composition with silicone thereby resulting in a moisture barrier, improved burn characteristics, and/or relatively more gas upon combustion.

The gas generant compositions contain one or more fuels, at least one oxidizer, and if desired, other additives well known in the art. In general, compounds that function primarily as binders are not required or used in the gas generant compositions described herein. Therefore, elastomeric, rubber, or silicone binders are not combined or mixed into the gas generant composition. One of ordinary skill will appreciate, however, that the silicone coating functions not as a binder but as a moisture inhibitor, as an auxiliary fuel, and as an ignition and/or combustion aid.

Stated another way, the use of a silicone coating, polydimethylsiloxane (PDMS) for example, results in reduced moisture retention, a greater percentage of gas combustion products per gram of a given coated gas generant composition, and an improved sustained combustion as compared to exemplary uncoated "smokeless" gas generant compositions.

BRIEF DESCRIPTION OF THE DRAWING

The FIGURE graphically illustrates the preferred ballistic performance of silicon-coated gas generant compositions as compared to the same uncoated compositions containing silicone as a binder.

DETAILED DESCRIPTION OF THE PREFERRED EMBODIMENT(S)

In accordance with the present invention, the combustion and ballistic properties of a given nonazide gas generant composition, particularly within a gas generator of an airbag inflator or within a seatbelt pretensioner, may be improved by coating the gas generant composition with silicone. By coating the outside of the generant pellets or granules with a curable silicone or silicone gumstock, an easily ignitable formulation that sustains combustion is obtained. Exemplary inflators/gas generators include those described in co-owned U.S. Pat. Nos. 5,628,528, 5,622,380, 5,727,813, and 5,806,888 herein incorporated by reference. Exemplary pretensioners include those described in U.S. Pat. Nos. 5,397,075 and 5,899,399, herein incorporated by reference.

The nonazide gas generant compositions contain one or more fuels, at least one oxidizer, and if desired, other additives well known in the art. In general, compounds that function primarily as binders are not required given that the granules, pellets or tablets are pressure formed. Therefore, elastomeric binders (i.e. rubber or silicone, and the like) are not combined or mixed into the gas generant composition, particularly in view of the ballistic performance of gas generant compositions containing such binders. See Example 1 and the FIGURE. Other binders not having an elastomeric nature may be used if desired, however.

Stated another way, the gas generant compositions do not include azides as fuels, nor do they contain any azido or azide groups within any constituent combined therein. The gas generant compositions contemplated herein contain a nitrogen-containing fuel selected from the group including tetrazoles, bitetrazoles, triazoles, triazines, guanidines, nitroguanidines, metal and nonmetal salts and derivatives of the foregoing fuels, and mixtures thereof; and, an oxidizer selected from the group including nonmetal or metal (alkali, alkaline earth, and transitional metals) nitrates, nitrites, chlorates, chlorites, perchlorates, oxides, and mixtures thereof. Exemplary fuels include nitroguanidine, guanidine nitrate, aminoguanidine nitrate, 1H-tetrazole, 5-aminotetrazole, 5-nitrotetrazole, 5,5'-bitetrazole, diguanidinium-5,5'-azotetrazolate, nitroaminotriazole, and melamine nitrate; and metal and nonmetal salts of the foregoing fuels.

U.S. Pat. Nos. 5,035,757, 5,139,588, 5,531,941, 5,756,929, 5,872,329, 6,077,371, and 6,074,502, herein incorporated by reference, exemplify, but do not limit, suitable gas generant compositions. In general, any gas generant composition (within any gas generator or any pretensioner, for example) may be coated with silicone, thereby resulting in improved ignitability and improved combustion and ballistic properties. As shown in Examples 4–9, the burn rate is vigorously sustained throughout combustion of a gas generant composition coated with silicone.

Exemplary nitrated fuels employed in "smokeless" gas generant compositions include nitrourea, 5-aminotetrazole nitrate (5ATN), dinitrodiaminotriazole, urea nitrate, azodicarbonamide nitrate, hydrazodicarbonamide nitrate, semicarbazide nitrate, and carbohydrazide nitrate, biuret nitrate, 3,5-diamino-1,2,4-triazole nitrate, dicyandiamide nitrate, and 3-amino-1,2,4-triazole nitrate. Certain fuels may be generically described as containing a nitrated base fuel such that the end compound will be the base fuel plus $HNO_3$. For example, urea nitrate is $H_2NCONH_2.HNO_3$. It is conceivable that some of the fuels may be dinitrates although most will be mononitrates.

One or more "smokeless" fuels may also be selected from the group including amine salts of tetrazole and triazole including monoguanidinium salt of 5,5'-Bis-1H-tetrazole (BHT.1 GAD), bis-(1(2)H-tetrazole-5-yl)-amine (BTA.2$NH_3$), diguanidinium salt of 5,5'-Bis-1H-tetrazole (BHT.2GAD), monoaminoguanidinium salt of 5,5'-Bis-1H-tetrazole (BHT.1AGAD), iaminoguanidinium salt of 5,5'-Bis-1H-tetrazole (BHT.2AGAD), monohydrazinium salt of 5,5'-Bis-1H-tetrazole (BHT.1HH), dihydrazinium salt of 5,5'-Bis-1H-tetrazole (BHT.2HH), monoammonium salt of 5,5'-bis-1H-tetrazole (BHT. 1$NH_3$), diammonium salt of 5,5'-bis-1H-tetrazole (BHT.2$NH_3$), mono-3-amino-1,2,4-triazolium salt of 5,5'-bis-1H-tetrazole (BHT. 1ATAZ), di-3-amino-1,2,4-triazolium salt of 5,5'-bis-1H-tetrazole (BHT.2ATAZ), 5,5'-Azobis-1 H-tetrazole (ABHT.2GAD), and monoammonium salt of 5-Nitramino-1H-tetrazole (NAT.1$NH_3$). Co-owned U.S. Pat. Nos. 5,872,329, 5,501,823, 5,783,773, and 5,545,272, each incorporated by reference herein, further elaborate on other "smokeless" gas generants and the manufacture thereof. Other "smokeless" gas generant compositions known in the art and as defined herein are also contemplated.

The gas generant compositions of the present invention further contain one or more inorganic oxidizers selected from the group of nonmetal, alkali metal, and alkaline earth metal nitrates and nitrites for example. Other oxidizers well known in the art may also be used. These include oxides or coordination complexes, for example. Preferred oxidizers include phase stabilized ammonium nitrate, ammonium nitrate, potassium nitrate, and strontium nitrate.

The gas generant composition, absent the silicone coating, contains 15–95% by weight of fuel and 5–85% by weight of oxidizer. The gas generant composition more preferably contains 20–85% by weight of fuel, and 15–80% by weight of oxidizer (not including the silicone coating). The gas generant constituents are homogeneously dry or wet blended and then formed into granules (800 $\mu$m to 12 mm, and more preferably 0.1 mm to 3 mm, in rough diameter), pellets, tablets, or other desired shapes by well known methods such as extrusion or pressure forming methods. The gas generant composition is then physically coated with 1–50%, and more preferable 3–20%, by weight (gas generant and the silicone) of a silicone gumstock or curable silicone polymer. Gas generant granules, tablets, pellets, or other desired shapes are formed and then added with an effective amount of silicone to a tumble blender and blended, preferably for at least two hours.

The term "silicone" as used herein will be understood in its generic sense. Hawley describes silicone (organosiloxane) as any of a large group of siloxane polymers based on a structure consisting of alternate silicon and oxygen atoms with various organic radicals attached to the silicon:

Formula 1: Silicone Example

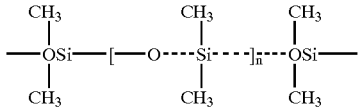

Or, silicone can be more generically represented as shown in Formula 2 (but not thereby limited):

Formula 2: Silicone Example

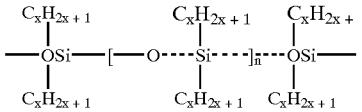

Note, "n" in the Formulas indicates a multiple of the polymeric group or portion of the molecule given within the brackets, to include the organic groups attached to the silicon.

Exemplary silicones include those disclosed in U.S. Pat. Nos. 5,589,662, 5,610,444, and 5,700,532, and, in *Technology of Polymer Compounds and Energetic Materials*, Fraunhofer-Institut fur Chemische Technologie (ICT), 1990, each reference and document herein incorporated by reference.

Standard slag formers and coolants may also be incorporated if desired. Binders are not generally utilized because the gas generant constituents described herein are homogeneously blended and then preferably compacted or formed into granules or other shapes through pressure or other known physical methods. If binders are used, however, elastomeric, rubber, or silicone binders are not combined in the present compositions given the poor ballistic performance shown in the Figure.

Other "smokeless" gas generant compositions containing 5-ATN, or any other nitrated base fuel, are also contemplated. The base fuels include, but are not limited to, nitrourea, 5-aminotetrazole, diaminotriazole, urea, azodicarbonamide, hydrazodicarbonamide, semicarbazide, carbohydrazide, biuret, 3,5-diamino-1,2,4-triazole, dicyandiamide, and 3-amino-1,2,4-triazole. Each of these base fuels may be nitrated and combined with one or more oxidizers. Thus, methods of forming gas generant compositions containing 5ATN and one or more oxidizers, as described below but not thereby limited, exemplify the manufacture of gas generant compositions containing any nitrated base fuel and one or more oxidizers.

The constituents of the nitrated gas generant compositions may all be obtained from suppliers well known in the art. In general, the base fuel (in this case 5AT) and any oxidizers are added to excess concentrated nitric acid and stirred until a damp paste forms. This paste is then formed into granules by either extrusion or forcing the material through a screen. The wet granules are then dried.

The nitric acid can be the standard reagent grade (15.9M, –70 wt. %$HNO_3$) or can be less concentrated as long as enough nitric acid is present to form the mononitrate salt of 5AT. The nitric acid should be chilled to 0–20° C. before adding the 5AT and oxidizers to ensure that the 5AT does not decompose in the concentrated slurry. When mixing the 5AT and oxidizers in the nitric acid medium, the precise mixing equipment used is not important—it is simply necessary to thoroughly mix all the components and evaporate the excess nitric acid. As with any process using acids, the materials of construction must be properly selected to prevent corrosion. In addition, sufficient ventilation and treatment of the acid vapor is required for added safety.

After forming a wet paste as described above, several methods can be used to form granules. The paste can be placed in a screw-feed extruder with holes of desired diameter and then chopped into desired lengths. An oscillating granulator may also be used to form granules of desired size. The material should be kept wet through all the processing steps to minimize safety problems. The final granules can be dried in ambient pressure or under vacuum. It is most preferred to dry the material at about 30° C. under a-12 psig vacuum.

The present invention is further illustrated by the following representative examples.

EXAMPLE 1 a) Preparation of Silicone-coated Granules The following mixture was ground and homogeneously mixed in a Sweco vibroenergy mill:

57.05% strontium nitrate (SN)

28.95% 5-amino-1H-tetrazole (5AT)

6.00% potassium salt of 5AT (K5AT)

8.00% bentonite clay (as a coolant)

The resulting powder was pressed into large "slugs" on a rotary press. The "slugs" were then passed through a Co-Mil granulator and the granules that passed through a No. 10 mesh screen and were retained on a No. 16 mesh screen were kept. The resultant product was a hard granule of consistent particle size. These granules were then split into two groups and coated with GE RTV615*, a two-component silicone. RTV615A (first component) and RTV615B (second component) were first combined and then added to the granules. Group 1 consisted of 97% granules and 3% RTV615. Group 2 consisted of 85% granules and 15% RTV615. Each combination was mixed so that the granules were thoroughly coated with the RTV615 silicone. The RTV615 was then allowed to cure. The resultant product consisted of free-flowing granules coated with silicone.

GE RTV615 identifies the proprietary name of a silicone manufactured by General Electric. The main constituents in the two-part silicone include vinylpolydimethylsiloxane at about 60–80 wt. % and vinyl-containing resin at about 10–30 wt. %. RTV615 will cure completely at ambient temperature in about 6–7 days (but sufficiently in 24 hours). The application of heat substantially quickens the cure rate so that at 65 C the cure rate is about 4 hours and at 150 C the cure rate is about 15 minutes. The viscosity of uncured RTV615 approximates 4000–7000 centipoise.

b) Preparation of Silicone-coated Powder

SN, 5AT, K5AT, and clay were all ground separately and then combined with RTV615 silicone in the following proportions:

Group 3:

55.34% strontium nitrate (SN)

28.08% 5-amino-1H-tetrazole (5AT)

5.82% potassium salt of 5AT (K5AT)

7.76% bentonite clay (as a coolant)

3.00% RTV615 silicone

Group 4:

48.49% strontium nitrate (SN)

24.61 % 5-amino-1H-tetrazole (5AT)

5.10% potassium salt of 5AT (K5AT)

6.80% bentonite clay (as a coolant)

15.00% RTV615 silicone

For Groups 3 and 4, the goal was to form a homogeneous mixture of the five constituents that was cohesive and could be formed into granules. For Group 3, there was not enough silicone to form a cohesive mixture and granules could not be formed. For Group 4, enough silicone was present to form good granules. After curing, the Group 4 granules were much softer than the granules from Groups 1 and 2.

Hygroscopicity Testing

For Groups 1 and 3, a 5 g sample was placed in an open dish and placed in an environmental chamber at 22 C and 50% relative humidity. The following moisture gains (percent by weight) were observed as a function of exposure time.

| Group | Description of Granules | Moisture Gain After One Day | Moisture Gain After Five Days |
|---|---|---|---|
| 1 | Coated with 3% Si | 1.68% | 4.28% |
| 3 | Intimate mixture: 3% Si | 5.08% | 7.34 |

As shown above, coating the mixture as opposed to mixing it within the granules reduces the moisture retained over time.

Ballistic Testing

Micro-gas generators (MGGs) were built as described below to determine the ballistic performance differences between the Groups 1–4. In each case, 1.0 g of the granules were loaded into a small aluminum cup that was then crimped to a standard initiator containing 110 mg of zirconium potassium perchlorate. The MGGs were then loaded in a sealed bomb of volume 10 cubic centimeters and fired. The pressure inside the bomb was measured as a function of time. The data are presented in the Figure. As shown in the curves for Groups 1 and 2, regardless of the amount of silicone coating, the performance of the coated granules is very similar. However, as shown in the curves for Groups 3 and 4, the performance of the intimate mixtures containing different percent weights of silicone varies significantly.

It can therefore be concluded that in contradistinction to the use of silicone as a binder, when silicone is used as a coating the ballistic tailorability is not substantially affected by tailoring the percent weight of silicone. It should further be noted that silicone when used as a binder in relatively greater amounts (Group 4) approximates a more linear curve in the ballistic profile and therefore apparently does not provide the optimum pressure over time as generally defined by the Group 1 and 2 curves.

The effects of the change in pressure over time with regard to the intimate mixtures of Groups 3 and 4 can be illustrated through the operation of known seatbelt pretensioners. When a composition of Group 4 is used, the pretensioner simply does not operate expediently enough to provide adequate pretensioning of the seatbelt. On the other hand, when a composition of Group 3 is used, the pretensioner is rendered inoperable (based on clutch failure, for example) due to the extreme pressure over the approximate period of time shown on the graph as 0.001 to 0.004 seconds. Examples 2 and 3 illustrate the nitration process and/or forming gas generant compositions containing nitrated fuels.

EXAMPLE 2

100 ml of concentrated nitric acid (15.9M, Reagent Grade from Aldrich) was added to a glass-lined, stirred, and jacketed vessel and cooled to 0 C. 100 g of dry 5AT (Nippon Carbide), 58 g of dry AN (Aldrich ACS Grade), and 6.5 g of dry KN (Aldrich ACS Grade) were then added to form a slurry in nitric acid. As the mixture was stirred, the excess nitric acid evaporated, leaving a doughy paste consisting of a homogeneous mixture of 174 g 5AT nitrate, 64.5 g PSAN10, and a small amount of nitric acid. This material was then passed through a low-pressure extruder to form long 'noodles' that were consequently chopped to from cylindrical granules. These granules were then placed in a vacuum oven at 30° C. and −12 psig vacuum overnight. After drying, the granules were screened and those that passed through a No. 4 mesh screen and were then retained on a No. 20 mesh screen were kept.

EXAMPLE 3

100 ml of 70 wt. % $HNO_3$ solution equals 99.4 g (1.58 mol) $HNO_3$ plus 42.6 g (2.36 mol) $H_2O$. The solution is mixed by stirring in 100 g dry 5-aminotetrazole (5-AT) which equals 1.18 mol 5-AT, 58 g dry ammonium nitrate (AN), and 6.5 g potassium nitrate (KN) (10% of total AN+KN). The sequence of addition is not critical. As mixing occurs, 5-AT is converted into a nitric acid salt: 5-AT(11.18 mol=100 g)+$HNO_3$ (1.18 mol=74.4 g)=5-AT.$HNO_3$. The AN and KN dissolve in the water present. Excess $HNO_3$ (99.4 g–74.4 g=25 g) and $H_2O$ (42.6 g) evaporate as the mixture is stirred. As this occurs, AN (58 g) 3 Intimate mixture: 3% Si 5.08% 7.34 and KN(6.5 g) coprecipitate to form PSAN10 (64.5 g). Meanwhile, the 5-AT. $HNO_3$ formed while mixing is intimately mixed with the PSAN10. After mixing is complete, the end result is an intimate mixture of 174 g of 5-AT.$HNO_3$+64.5 g PSAN10 with a small amount of $HNO_3$ and $H_2O$ to keep the mixture in a doughy or pasty form.

Granules or pellets are then formed from the paste by methods well known in the art. The granules or pellets are then dried to remove any residual $HNO_3$ and $H_2O$. The end product consists of dry granules or pellets of a composition containing about 73 wt. % 5-AT.$HNO_3$+27 wt. % PSAN10.

EXAMPLES 4–9

Silicone Coating of Formulations Containing 5-AT.$HNO_3$

The following mixtures were prepared as described in Example 3.

| Example | % 5ATN | % PSAN10 |
|---|---|---|
| 4 | 73.12 | 26.88 |
| 5 | 60.00 | 40.00 |
| 6 | 39.36 | 60.64 |

The granules produced above were coated with RTV615 silicone by adding the silicone to the granules and gently blending the mixture in a Ross double-planetary mixer. The resultant formulations are given below as Examples 7–9. Example 7: 90 parts Example 4 granules and 10 parts RTV615 silicone coating. Example 8: 85 parts Example 5 granules and 15 parts RTV615 silicone coating. Example 9: 95 parts Example 6 granules and 5 parts RTV615 silicone coating. The ignition and propagation properties of Examples 4–9 were tested qualitatively by igniting a small sample of each example. The following observations are noted:

| Example | Ease of Ignition with Propane Torch | Speed of Propagation Once Ignited |
|---|---|---|
| 4 | Good Ignition | Fast |
| 5 | Moderate Ignition | Moderate |
| 6 | Poor Ignition | Slow |
| 7 | Excellent Ignition | Fast |
| 8 | Excellent Ignition | Fast |
| 9 | Good Ignition | Slow |

The torch test indicates that the addition of a silicone coating to various 5ATN/PSAN10 (5-aminotetrazole nitrate/ammonium nitrate stabilized with 10% potassium nitrate) "smokeless" formulations improved the ignitability, combustion sustenance, and speed of combustion propagation. Based on Example 1, it is believed that an additional benefit is moisture protection.

While the foregoing examples illustrate and describe the use of the present invention, they are not intended to limit the invention as disclosed in certain preferred embodiments herein. Therefore, variations and modifications commensurate with the above teachings and the skill and/or knowledge of the relevant art, are within the scope of the present invention.

We claim:

1. In a vehicle occupant protection system containing a binderless gas generant composition formed into a desired shape, the improvement comprising:

a silicone coating applied about the gas generant composition, said coating provided at 1–50% by weight relative to the combined weight of the gas generant composition and silicone.

2. A product formed from the method comprising the steps of:

providing powdered gas generant constituents including a fuel and an inorganic oxidizer, but not an elastomeric binder;

homogeneously wet or dry blending the gas generant constituents;

forming the gas generant blend into desired shapes;

coating the gas generant shapes with uncured silicone; and curing the silicone covered shapes.

3. A nonazide gas generant composition comprising a nitrogen-containing fuel and an inorganic oxidizer, said composition formed into a desired shape, wherein the composition further comprises:

a silicone coating about the desired shape, said silicone provided at 1–50% by weight relative to the combined weight of the gas generant composition and the silicone.

4. The gas generant composition of claim 3 wherein:

said nitrogen-containing fuel is selected from the group consisting of tetrazoles, bitetrazoles, triazoles, triazines, guanidines, and metal and nonmetal salts and derivatives of the foregoing fuels, and mixtures thereof; and said inorganic oxidizer is selected from the group of nonmetal or metal nitrates, nitrites, chlorates, chlorites, perchlorates, oxides, and mixtures thereof.

5. The gas generant composition of claim 4 wherein:

said nitrogen-containing fuel is selected from the group consisting of nitroguanidine, guanidine nitrate, aminoguanidine nitrate, 1H-tetrazole, 5-aminotetrazole, 5-aminotetrazole nitrate, 5-nitrotetrazole, 5,5'-bitetrazole, diguanidinium-5,5'-azotetrazolate, nitroaminotriazole, melamine nitrate, and metal and nonmetal salts of the foregoing fuels.

6. The gas generant composition of claim 4 wherein:

said inorganic oxidizer is selected from the group consisting of phase stabilized ammonium nitrate and strontium nitrate.

7. The gas generant composition of claim 4 wherein:

said inorganic oxidizer is selected from the group consisting of alkali, alkaline earth, and transitional metal nitrates, nitrites, chlorates, chlorites, perchlorates, oxides, and mixtures thereof.

* * * * *

UNITED STATES PATENT AND TRADEMARK OFFICE

CERTIFICATE OF CORRECTION

PATENT NO. : 6,620,266 B1 
DATED : September 16, 2003
INVENTOR(S) : Graylon K. Williams et al.

It is certified that error appears in the above-identified patent and that said Letters Patent is hereby corrected as shown below:

Title page,
Item [56], References Cited, U.S. PATENT DOCUMENTS, replace "Blomauist" with -- Blomouist --.

Column 3,
Lines 21, 24, 26, 27 and 28, replace "Bis" with -- bis --.
Line 25, replace "iaminoguanidinium" with -- diaminoguanidinium --.
Line 33, insert -- diguanidinium salt of -- before "5,5' - Azobis -1 H-tetrazole".

Column 5,
Line 22, insert -- - -- before "The following".
Lines 37-42, replace font size to match rest of print
Lines 43-53, reduce font size to smaller font.

Column 7,
Line 5, replace "0 C" with -- 0ºC --.
Line 29, replace "11.18" with -- 1.18 --.
Lines 33-34, delete "Intimate mixture: 3% Si 5.08% 7.34 --.

Signed and Sealed this

Twenty-seventh Day of April, 2004

JON W. DUDAS
*Acting Director of the United States Patent and Trademark Office*